United States Patent [19]

Burstedt

[11] Patent Number: 4,856,716

[45] Date of Patent: Aug. 15, 1989

[54] GYRATORY CRUSHER CONTROL

[75] Inventor: Jan E. Burstedt, Mobackavägen, Sweden

[73] Assignee: Boliden Aktiebolag, Stockholm, Sweden

[21] Appl. No.: 96,444

[22] Filed: Sep. 15, 1987

[51] Int. Cl.[4] ..... B02C 2/00; B02C 25/00

[52] U.S. Cl. ..... 241/30; 241/37

[58] Field of Search ..... 241/30, 37, 207–216

[56] References Cited

U.S. PATENT DOCUMENTS

| | | | |
|---|---|---|---|
| 3,117,734 | 1/1964 | McCarty et al. | 241/37 X |
| 3,133,707 | 5/1964 | Zimmerman . | |
| 3,568,938 | 3/1971 | Barrot et al. | 241/37 X |
| 3,944,146 | 3/1976 | Stockmann et al. | 241/37 X |
| 4,697,745 | 10/1987 | Sawant et al. | 241/30 |
| 4,712,743 | 12/1987 | Nordin | 241/37 X |

FOREIGN PATENT DOCUMENTS

| | | |
|---|---|---|
| 159975 | 10/1985 | European Pat. Off. . |
| 2433981 | 3/1980 | France . |
| 400035 | 3/1978 | Sweden . |
| 411102 | 12/1979 | Sweden . |
| 2090770 | 7/1982 | United Kingdom . |
| 87/01305 | 3/1987 | World Int. Prop. O. . |

OTHER PUBLICATIONS

G. Schmidt, "Krupp Kubria Cone Crushers, Esch Type—Their Application as Secondary/Tertiary Crusher Units", *Erzmetall* vol. 33, No. 7/8, Jul./Aug., 1978, pp. 383–386.

*Primary Examiner*—Joseph M. Gorski

*Attorney, Agent, or Firm*—Fleit, Jacobson, Cohn, Price, Holman & Stern

[57] ABSTRACT

A method for controlling a crushing gap width of a gyratory crusher of the kind including a crusher head is disclosed. The crusher head of the crusher is driven by a power unit and is positionally adjustable in relation to a crusher shell by a hydraulic motor. The hydraulic motor moves the crusher head of the crusher, thereby adjusting the crushing gap width. A power consumption of the crusher, pressure load on the crusher head, and the width of the crushing gap are determined continuously. The crushing gap width is controlled by being adjusted when the gap width is, above a predetermined minimum gap width value, substantially in accordance with a control function which depends on both the power consumption and the pressure load, and which is so selected as to provide an intended crushing effect the material being crushed.

14 Claims, 2 Drawing Sheets

GYRATORY CRUSHER CONTROL

The present invention relates to a method for controlling the crushing gap width of a gyratory crusher of the kind which includes a crusher head which is driven by a power unit and which for the purpose of adjusting the crushing gap can be adjusted positionally in relation to a crusher shell by means of a hydraulic motor, the method comprising continuously determining the power consumption of the crusher, the pressure load acting on the crusher head, and the width of the crushing gap, and controlling the crushing gap width, above a pre-determined minimum gap width value, in dependence on said power consumption and said pressure load.

Such a method is previously known from, e.g., SE-B-411 102. According to this publication the crushing gap width is adjusted, or regulated, indirectly by determining a minimum value and a maximum value for the power consumption of the power unit; alternatively, or in addition thereto, determining a minimum value and a maximum value for the pressure load on the crusher head; measuring the power consumed and optionally the pressure load during a crushing operation; increasing the crushing gap width stepwise, when the maximum value for the power consumption or the pressure load is exceeded over a given period of time, until the power consumption or pressure load has fallen and lies immediately beneath said maximum value; decreasing the crushing gap width again, until the maximum value for the power consumption and/or the pressure load is exceeded; and then again increasing the gap width, and so on. Thus, according to SE-B-411 102 the crushing gap width is, in principle, constantly set to the smallest possible value permitted by the maximum power consumption value and/or the maximum pressure load value. The aforesaid maximum values thus also constitute set-point values.

In accordance with a further development of the known method, the crushing gap is controlled indirectly by determining respective upper and lower limit values for the power consumption of the power unit, for the pressure load on the crusher head, and for the width of the crushing gap, and measuring the power consumed by the crusher, the pressure load, and the width of the crushing gap while the crusher is at work. If the upper limit value for either the power consumption or the pressure load is exceeded for a given period of time and the prevailing gap width is smaller than the upper limit value for the gap width, the width of the crushing gap is increased stepwise until the prevailing power consumption and the prevailing pressure load lie beneath said upper limit values therefor. If the lower limit value for either the power consumption or the pressure load is not exceeded for a given period of time and the prevailing gap width exceeds the lower limit value for the gap width, the gap width is decreased stepwise until the prevailing gap width is equal to said lower limit value, or until said lower limit values for power consumption and pressure load are exceeded before said gap width has reached its lower limit value. Thus, the gap width of this alternative embodiment is also adjusted so as to lie constantly as close to the lower gap limit as is allowed by the limit values for the power consumption and pressure load.

Although the aforedescribed adjustment methods constitute an advance in relation to manual control, it can prove uneconomical to adjust the crushing gap width in a manner such that the crusher will constantly operate at the smallest possible gap width or as close as possible to the lower limit of a pre-determined gap width range with regard to the permitted power consumption of the crusher and/or the permitted pressure load on the crusher head. Considerable increases in production can namely be achieved through the agency of so-called interaction, i.e. a process in which crushing is effected by the mutual crushing action of ingoing lumps of material, one against the other, and in which the width of the crushing gap can thus be allowed to exceed considerably the cross-dimensions of the crushed material.

An object of the present invention is to provide a novel and advantageous control method which will ensure that crushing is achieved in the manner intended within the whole of the possible power output and the possible pressure load range of the crusher, thus in principle from idling power to a maximum permitted power output and from a state of no load on the crusher head to a state of maximum load thereon.

It has been discovered, in accordance with the invention, that for each combination of power output and pressure load there is found a correspondng crushing gap width at which the crusher will crush material in an intended manner, e.g. when crushing a given ore the crusher will provide maximum production of a crushed product within a given size range. Accordingly, it is proposed in accordance with the invention that when carrying out a method of the aforesaid kind the width of the crushing gap is maintained, above said minimum value thereof, at a setting essentiallly in accordance with a control function which is conditionally dependent on both the power consumption and the pressure load, and which is so selected as to provide an intended crushing effect on the material being crushed.

The easiest way to determine the control function for a given material to be crushed in a specific crusher is to run crushing tests in the crusher which is to be used or in a similar crusher, partly under conditions in which the pressure load is negligible and does not change to any appreciable extent when changes occur in the crushing gap width, e.g. by feeding dry and well-screened material, i.e. material which is essentially free from fines, to the crusher, and partly under conditions in which the pressure load changes appreciably when changes occur in the crushing gap width, e.g. by feeding moist and non-screened material to the crusher. When carrying out crushing tests with dry, well-screened material, the material input feed is set at a constant value and the crushing gap width is set to a value in which the desired crushing effect is obtained to the highest extent possible, i.e. a crushing effect in which a maximum amount of material lies within a given desired particle size range, while recording the corresponding gap widths and power consumptions. The fact as to whether or not the desired crushing effect has been achieved to the best extent possible can be checked by examining the crushed material. Crushing tests are then carried out with the dry, well-screened material at other material input feeds and the crushing gap width is again set to a value at which the desired crushing effect is obtained to the best extent possible, while again recording the corresponding gap widths and power consumptions. The values recorded with regard to gap widths and corresponding power consumptions can then be plotted to provide a curve which illustrates how the gap width should be changed in response to changes in power consumption if the desired crushing effect shall be obtained to the best extent possible. When crushing corresponding material which is moist and where screening is deficient or incomplete, the input material feed is set to mutually different values and the crushing gap width is adjusted at each of these values in a manner to obtain the desired crushing effect to the best possible extent, while determining the power consumed by the crusher motor at said values. By comparing these gap widths with the gap widths applicable to the same power consumption according to the curve representing the dry and well-screened material, it is possible to determine the additional gap width required when crushing moist and incompletely screened material in order to maintain the desired crushing effect to the greatest possible extent at varying pressure loads. These additional values can be used to plot a curve showing how the gap width shall be changed with changes in pressure load, if the desired crushing effect is to be achieved to the best possible extent.

The aforesaid curves can be expressed mathematically and inserted in a control function which calculates the preferred width toward which the crushing gap should be adjusted when crushing the material concerned, and the control function may also contain stipulations concerning the minimum gap size, so as to prevent physical contact of the crusher head with the crusher cone, and also data concerning a pressure calculation limit which is dependent on the natural weight of the head and on the weight of the material present in the crusher, and from which the extent to which the pressure load contributes to the gap width shall be initially calculated. Such a control function, in accordance with which the gap width is adjusted, can be expressed, e.g., by the formula $$S_B = \frac{E}{P + \frac{E}{Q} + \frac{E^2}{R}} + [(T - T_o) \cdot C_T]^a + I$$

in which $S_B$=the gap set point value in mm
E=the power output of the crusher motor in kW
P=a constant
Q=a constant
R=a constant
a=an exponent
T=pressure in MPa
$T_o$=the pressure calculation limit in MPa
$C_T$=a constant
I=minimum gap width in mm, the constants P, Q and R being determined from said power consumption curve and the constants $C_T$ and the exponent a being determined from said pressure load curve.

One important advantage afforded by the invention is that it is not necessary to control accurately the flow of material to the crusher or the lump or particle size distribution of the material, provided that the crusher is allowed to work within the limits of its capacity. In order to avoid continuous adjustments to the gap width, the width of the gap is preferably not adjusted until the prevailing gap width has deviated from the preferred gap width calculated in accordance with the control function to a predetermined extent, suitably within the range of 2–15%, and for a pre-determined length of time, suitably from 3 to 10 seconds. Overloading of the crusher is avoided by increasing the gap width beyond the values calculated in accordance with the control function, when the power consumption and/or the pressure load exceeds pre-determined maximum values, thereby avoiding interruptions in production as a result of triggering a motor cut-out device or the like.

If the power consumption of the crusher motor falls rapidly to a level corresponding to idling power, e.g. due to a temporary interruption in the supply of material to the crusher, the control function is conveniently blocked so as to maintain the gap width at the value that prevailed when idling power was reached, until the time when the power consumption has again risen above the idling level, e.g. by re-starting the feed of material to the crusher.

Similarly, after an interruption in operation, the crusher is preferably started-up with a gap width which substantially exceeds the minimum gap width and which preferably corresponds to 25–50% of the eccentric radius of the crusher head.

The invention will now be described with reference to the accompanying drawings, while disclosing additional characteristic features of the invention and advantages afforded thereby.

Figure 1:
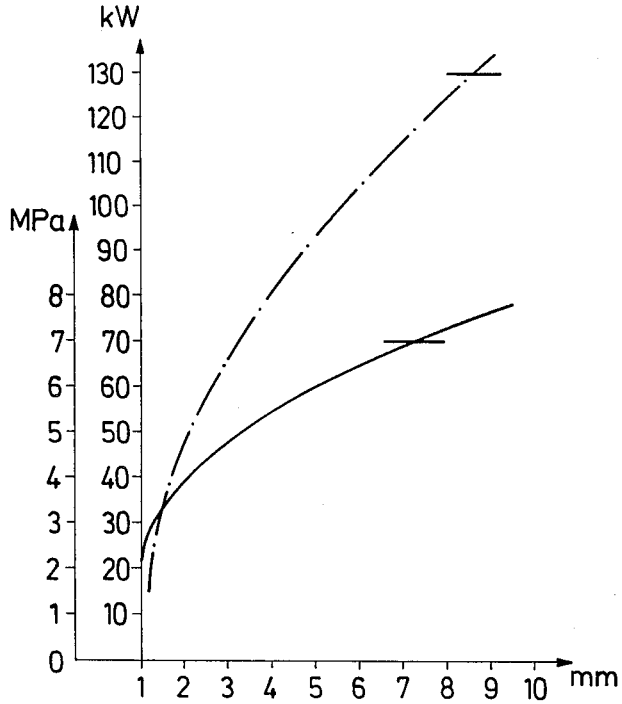
FIG. 1 illustrates control curves which are intended for controlling a fine crusher in accordance with the invention and which derive from tests carried out.

FIG. 1 shows two curves derived from the above-mentioned control function, where P=79.64
Q=1.128
R=320.3
$T_o$=2 MPa
$C_T$=0.5
a=2, and
I=2 mm The control function was determined by crushing tests in accordance with the method described above on sulphide ore which had been coarsely crushed to a particle size below 100 mm and which emanated from Långdalsgruvan, Sweden. The crushing tests were carried out in a crusher of the Hydrocone No. 460 type from Svedala Arbrå AB having an electric motor with an idling power of 24 kW and a rated power output of 150 kW. The control function was compiled in order to produce, irrespective of the input feed of the material to the crusher, a product which is crushed essentially to a maximum such as to be suited for further comminution in a rod mill. At a power consumption and a pressure load in excess of 130 kW and 7 MPa, respectively, the gap width of the crusher was increased beyond the values calculated in accordance with said control function, in order to avoid the risk of damaging the motor or crusher. In FIG. 1 the broken-line curve is the power curve, and the continuous line curve is the pressure curve, whereas the upper limits for use of the control curves are marked with horizontal dashes. Controlling of a crushing process in accordance with the above results in a superior capacity at vaying flows, varying moisture contents and varying particle size distributions, and will also result in but small wear on wear elements, since such elements are utilized over substantially the whole of their working area. It will be understood that control of the crusher in accordance with the pre-determined function is effected automatically with the use of electronic control equipment.

Figure 2:
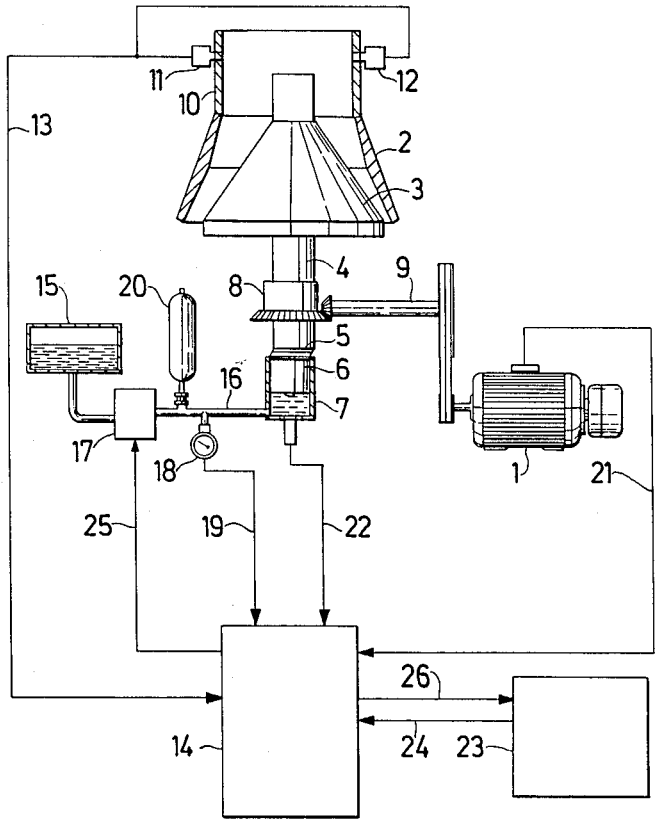
FIG. 2 illustrates schematically a crushing plant that can be controlled in accordance with the invention.

The crushing plant illustrated in FIG. 2 includes a gyratory crusher driven by an electric motor 1 and comprising a stationary, conicle crusher shell 2 and a moveable, conicle crusher head 3. The crusher head 3 is fixedly mounted on a post 4, the upper end of which is journalled in a bearing (not shown) for axial movement while being substantially immoveable in a radial direction. The bottom surface of the post 4 rests, via a slide bearing 5, on the piston 6 of a hydraulic piston-cylinder device, the cylinder of which is referenced by numeral 7. The post 4 is journalled beneath the crusher head 3 in an eccentrically located opening in a journal device 8 which is driven rotatably by means of the motor 1, via a transmission shown generally at 9. When the bearing device 8 is rotated, the crusher head 3 will therefore execute a gyratory movement, such that the gap between the crusher shell 2 and the crusher head 3 will increase and decrease around the periphery of the head. The journal device 8 may be made adjustable so as to enable the degree of eccentricity of the opening receiving the post 4 to be changed, and the post 4 together with the crusher head 3 can be raised and lowered respectively, by feeding hydraulic fluid to and removing hydraulic fluid from the cylinder 7, so as to adjust the width of the crushing gap, by which is meant the smallest distance between the outer surface of the crusher head 3 and the inner surface of the crusher shell 2, as is conventionally meant in the parlance of such crushers.

Located adjacent the upper part of the crusher shell is a shaft 10 through which material to be crushed is fed to the crusher. An ultrasonic transmitter and receiver 11, 12 monitors the supply of material and detects any blocking of the shaft 10, and may also be used for controlling the supply of material. The transmitter and receiver are connected, via a conductor 13, to an electronic unit 14 incorporated in an electronic control apparatus, and deliver to the electronic unit signals which are characteristic of the state of the shaft 10.

The reference 15 identifies a hydraulic-fluid tank which is connected to the cylinder 7 via a conduit 16. Hydraulic fluid is fed to and from the cylinder 7 by means of a pump 17 incorporated in the conduit 6. The pressure of the hydraulic fluid present in the cylinder 7 is continuously measured by means of a pressure meter 18, which sends an analogue signal corresponding to the pressure load acting on crusher head 3 to the electronic unit 14, via a conductor 19. The reference 20 identifies a conventional so-called pressure accumulator, which prevents the occurrence of unpermitted heavy pressure surges in the hydraulic system, should, for instance, a broken-off digger tooth or some other non-crushable object happen to pass through the crusher.

An analogue signal corresponding to the power consumption of the motor 1 is continuously determined sent to the electronic unit 14 via a conductor 21, whereas an analogue signal corresponding to the position of the crusher head 3 in relation to the crusher shell 2, and thus corresponding to the width of the crushing gap, is similarly continuously determined and sent to the electronic unit 14 over a conductor 22. The reference 23 identifies a display and control unit which is provided with means for selecting and programming in a desired control function and to supply control signals to the electronic unit 14, via a conductor 24, in response to the selected control function, so that the electronic unit 14, in response to said control function and in response to the signals arriving on the conductors 19, 21, 22, produces a digital control signal on a conductor 25 connected to the drive means of the pump 17. The unit 23 receives, via a conductor 26, signals corresponding to given states of the crusher plant, e.g. power consumption, pressure load, crushing gap width etc., these signals being converted to visisble data on the display part of the unit 23. It will be understood that the control equipment for controlling the crusher plant in accordance with the prevailing control function can be constructed in many different ways, all of which can be readily realized by one skilled in this art, and hence the control equipment will not be described in detail here, particularly since the construction of such control equipment, with the exception of the arrangement illustrated in FIG. 3, forms no part of the present invention.

Figure 3:
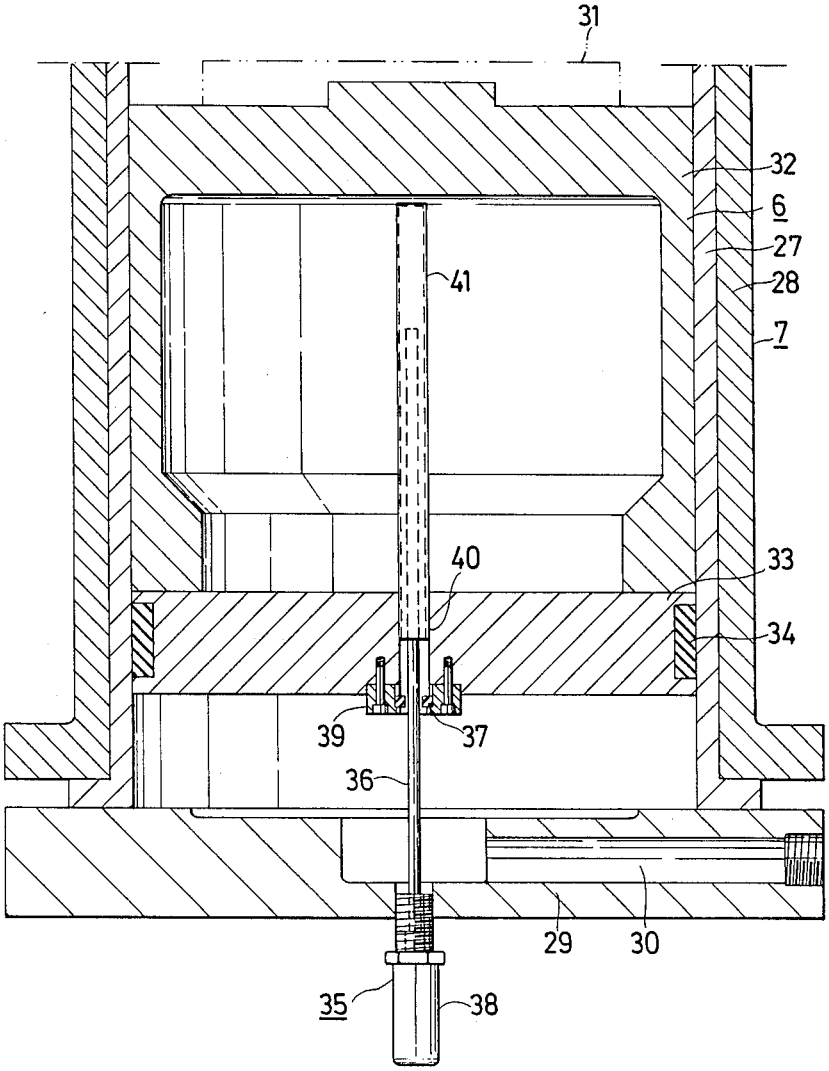
FIG. 3 is a detailed illustration of the method applied when determining the position of the crusher head, and therewith the gap width.

FIG. 3 illustrates in larger scale part of the piston-cylinder device 6, 7 illustrated in FIG. 2, and shows that the cylinder 7 comprises a lining 27 and an outer casing 28. The outer casing 28 is connected to a lower cylindrical end-wall 29 having provided, therein a channel 30 which connects the interior of the cylinder with the hydraulic fluid conduit 16 illustrated in FIG. 2. The cylinder 7 is open at its top and the piston 6 located in the cylinder has a considerable vertical extension and carries at its upper end surface a part 31, shown in chain lines, of the slide bearing 5 described with reference to FIG. 2 and intended for carrying the post 4 and the crusher head 3. The piston 6 is hollow and comprises a cup-shaped part 32 and a lid or cover member 33 which covers the downwardly facing opening of the part 32. Seals 34 are provided peripherally on the cover member 33, to prevent the leakage of oil between the outer surface of the piston 6 and the inner surface of the lining 27. Due to the gyratory movement of the post-end resting against the piston 6, via the journal 5, in combination with the heavy pressure on the piston 6 caused by the weight of the post 4 and the crusher head 3 and the pressure load on the crusher head during the crushing operation, it is extremely difficult, however, to avoid leakage of hydraulic fluid from the interior of the cylinder 7. Consequently, it is not suitable to determine the position of the crusher head 3, and therewith the width of the crushing gap, by determining the level of the hydraulic fluid in the tank 15 with the aid of a level sensor, as in accordance with conventional procedures, since the hydraulic fluid leaking from the interior of the cylinder 7 is not returned to the tank 15, and consequently it is often necessary to halt the crushing process in order to calibrate the level sensor in relation to the prevailing or actual position of the crusher head 3. This drawback is avoided with the arrangement according to FIG. 3, in that the position of the crusher head 3, and therewith the width of the crushing gap, is established by determining the position of the piston 6 and the cylinder 7 in relation to one another. This determination is not dependent on changes in the amount of hydralic fluid in the hydraulic system due to leakages from or re-filling of the system. A calibration need only be carried out at relatively wide intervals, in order to compensate for wear on the wear surfaces of the crusher shell and the crusher head. Thus, there is used in the FIG. 3 embodiment a position indicator, generally referenced 35, which includes a first part 36 which is stationary in relation to the cylinder casing 27, 28, 29, and a second part 37 which is stationary in relation to the piston 6 and which is intended to send to the electronic unit 14, via the conductor 22 shown in FIG. 2, a positional signal characteristic of the position of the two parts 36, 37 relative to one another and therewith characteristic of the position of the crusher head 3. In the illustrated embodiment, the position sensor includes a metal wire which is tensioned or stretched in a protective tube 36 in the axial direction of said tube and which is placed in vibration by means of a combined transmitter and receiver carried by the cylinder end-wall 29, whereas the part 37 comprises a ring-shaped permanent magnet which encircles the tube 36 and which is fitted to the cover member 33 of the piston 6 by means of a holder 39. The tube 36 extends through an opening 40 provided in the cover member 33 and into the interior of the piston 6, the tube being accommodated within the piston in a further tube 41 which is sealingly connected to the upwardly facing mouth of the opening 40 and which is operative in preventing hydraulic fluid from leaking into the interior of the piston 6. The arrangement is such that the vibrations (the tones) transmitted and received by the transmitter/receiver 38 are influenced by the magnet 37 such that the vibrations (tones) become characteristic of the distance between the transmitter/receiver 38 and the magnet 37. The transmitter 35 transmits an analogue signal to the electronic unit 14, via the conductor 22 shown in FIG. 2, characteristic of said distance.

The invention is not restricted to the embodiment described above with reference to the drawings, but can be realized in many ways within the scope of the invention defined in the following claims.

I claim:

1. A method for controlling a crushing gap width between a crusher head and a crusher shell of a gyratory crusher, said crusher head being adjustable in relation to the crusher shell by a hydraulic motor for adjusting said crushing gap width, comprising the steps of:

driving the crusher head by a power unit, continuously determining power consumption of the crusher, continuously determining pressure load acting on the crusher head, continuously determining the width of the crushing gap, selecting a gap width control function which is conditionally dependent on both the power consumption and the pressure load to provide an intended crushing effect on material being crushed, calculating a preferred gap width in accordance with said control function, and adjusting the crushing gap width, when the crushing gap width is above a pre-determined minimum crushing gap width, so that said crushing gap width is adjusted to said preferred gap width calculated in accordance with said control function by means of said hydraulic motor and physical contact between the crusher head and the crusher shell is prevented.

2. The method according to claim 1, wherein the step of adjusting the crushing gap width occurs only when said width has deviated from a preferred gap width calculated in accordance with said control function by a pre-determined extent and for a pre-determined length of time.

3. The method according to claim 2, wherein said pre-determined extent lies within the range of 2–15% of the preferred gap width.

4. The method according to claim 2, wherein said pre-determined length of time is 3–10 seconds.

5. The method according to claim 1, and further comprising the step of starting the gyratory crusher up at a pre-determined crushing gap width which exceeds the pre-determined minimum crushing gap width.

6. The method according to claim 5, and further comprising the steps of imparting to the crusher head a gyratory movement having an eccentric radius, and starting the crusher up at a pre-determined crushing gap width which amounts to 25–50% of said eccentric radius.

7. The method according to claim 1, and further comprising the steps of:

using a hydraulic piston-cylinder device as said hydraulic motor, measuring said width by means of a position sensor which includes a first part stationary in relation to a cylinder casing of said piston-cylinder device, and a second part which is stationary in relation to a piston of said piston-cylinder device, and transmitting a position signal characteristic of the positions of said parts in relation to one another, and therewith characteristic of the position of the crusher head, from said position sensor to means for calculating a preferred gap width.

8. A method for controlling a crushing gap width between a crusher head and a crusher shell of a gyratory crusher, said crusher head being adjustable in relation to the crusher shell by a hydraulic motor for adjusting said crushing gap width, comprising the steps of driving the crushing head by a power unit, continuously determining power consumption of the crusher, pressure load acting on the crusher head, and the width of the crushing gap, selecting a gap width control function which is conditionally dependent on both the power consumption and pressure load determined so as to provide an intended crushing effect on material being crushed, and adjusting the crushing gap width, when the crushing gap width is above a pre-determined minimum crushing gap width value to prevent physical contact between the crusher head and the crusher shell, in accordance with said control function, said control function being expressed by the formula $$S_B = \frac{E}{P + \frac{E}{Q} + \frac{E^2}{R}} + [(T - T_o) \cdot C_T]^a + I, \text{ wherein}$$

$S_B$ is the crushing gap width to which the crushing gap is adjusted in mm,

E is the power output of the power unit in kW,

P, Q and R are constants determined from a power consumption curve, a is an exponent and $C_T$ is a constant, both being determined from a pressure load curve, T is pressure in MPa of hydraulic fluid in said hydraulic motor, $T_o$ is a pressure calculation limit in MPa, and I is a minimum crushing gap width value in mm.

9. The method according to claim 8, wherein the step of adjusting the crushing gap width occurs only when said width has deviated from a preferred gap width calculated in accordance with said control function by a pre-determined extent and for a pre-determined length of time.

10. The method according to claim 9, wherein said pre-determined extent lies within the range of 2–15% of the preferred gap width.

11. The method according to claim 9, wherein said pre-determined length of time is 3–10 seconds.

12. The method according to claim 8, and further comprising the step of starting the gyratory crusher up at a pre-determined crushing gap width which exceeds the pre-determined minimum crushing gap width.

13. The method according to claim 12, and further comprising the steps of imparting to the crusher head a gyratory movement having an eccentric radius, and starting the crusher up at a pre-determined crushing gap width which amounts to 25–50% of said eccentric radius.

14. The method according to claim 8, and further comprising the steps of:

using a hydraulic piston-cylinder device as said hydraulic motor, measuring said width by means of a position sensor which includes a first part stationary in relation to a cylinder casing of said piston-cylinder device, and a second part which is stationary in relation to a piston of said piston-cylinder device, and transmitting a position signal characteristic of the positions of said parts in relation to one another, and therewith characteristic of the position of the crusher head, from said position sensor to means for calculating a preferred gap width.

* * * * *